US005794290A

United States Patent [19]

Roberts

[11] Patent Number: 5,794,290

[45] Date of Patent: Aug. 18, 1998

[54] METHOD AND APPARATUS FOR IMPROVING THE WASHING ABILITY OF WASH WATER IN A WASHING MACHINE

[76] Inventor: Denzil S. Roberts, 1471 Sherwood Drive, Nanaimo, British Columbia, Canada, V9T 1G8

[21] Appl. No.: 805,913

[22] Filed: Mar. 4, 1997

[51] Int. Cl.[6] ..... D06F 39/02

[52] U.S. Cl. ..... 8/159; 68/17 R; 68/17 A

[58] Field of Search ..... 68/3 R, 355, 207, 68/17 A, 134, 133; 8/159

[56] References Cited

U.S. PATENT DOCUMENTS

| | | | |
|---|---|---|---|
| 617,405 | 11/1899 | Pett | 68/30 |
| 2,318,758 | 4/1943 | Crimmel | 68/133 |
| 3,707,857 | 1/1973 | Wigfall | 68/12.27 |
| 5,211,689 | 5/1993 | Kobayashi . | |
| 5,309,739 | 5/1994 | Lee . | |
| 5,421,174 | 6/1995 | Kim et al. . | |

FOREIGN PATENT DOCUMENTS

| | | | |
|---|---|---|---|
| 502268 | 4/1951 | Belgium | 68/133 |

*Primary Examiner*—Frankie L. Stinson
*Attorney, Agent, or Firm*—Elbie R. de Kock

[57] ABSTRACT

A washing method performed in a washing machine having a wash basket for containing wash water and a wash load includes the step of attaching a tile 10 of a ceramic material to the inside of the wash basket 12 so that the tile 10 is exposed to the wash water in the wash basket 12. A laundry tile 10 of ceramic material for use in the method is provided. It comprises a front side 14 and a rear side 18, wherein the front side 14 is at least partially unglazed. In one embodiment attachment strips 20,22 are provided for attaching the tile 10 by its rear side 18 to the inside of the wash basket 12 of a washing machine.

5 Claims, 3 Drawing Sheets

METHOD AND APPARATUS FOR IMPROVING THE WASHING ABILITY OF WASH WATER IN A WASHING MACHINE

FIELD OF THE INVENTION

This invention relates to a method of improving the washing ability of wash water in a washing machine, as well as apparatus for carrying out the method.

BACKGROUND OF THE INVENTION

It is known that the presence of a ceramic material in water enhances the washing ability of the water and reduces or dispenses with the need for a detergent in the water. During the wash and rinse cycles, agitation of the wash load results in friction between the water and the ceramic. As a result, a surplus of hydroxyl ions are formed which reduces the surface tension of the water. The cleaning ability of the water is thereby enhanced.

There have been several applications of this principle in which a ceramic material or other water activating material, such as tourmaline, is provided inside a washing machine.

There is, for example, U.S. Pat. No. 5,309,739, which describes a clothes washing machine having a tourmaline ceramic coating on the bottom surface of the wash basket for reacting with the wash water to form hydroxyl ions which reduce the surface tension of the water. An ultrasonic vibrator is mounted on the wash basket across from the coating to generate waves in the wash water to accelerate the reaction between the coating and the wash water. Alternatively, the coating is applied to the agitator in the wash basket.

Another application is described in U.S. Pat. No. 5,421,174 in which a container with ceramic material is provided on the agitator in the wash basket of the washing machine. The container is provided with a plurality of holes for contact of the ceramic with the wash water.

In both the above applications, the washing machine is specially adapted for its specific purpose during the manufacturing stage and no provision is made for the application of the principle to a conventional washing machine.

In another application, as described in U.S. Pat. No. 5,211,689, the ceramic material is located inside a disc which is provided with an annular float. The ceramic material is in the form of spherical beads and the disc is provided with openings for contact between the wash water and the beads. In use, one or more of the discs are added to the wash load and they circulate through it during the wash cycle.

These discs have several disadvantages. Firstly, at least three types of material are used in the construction of the discs, i.e. ceramic material for the beads and two types of plastic material for the disc and the annular float respectively. The resulting high price for a set of two or three of these discs puts them out of reach of many potential users. Secondly, the discs are not designed to be fixed to the machine and may be damaged or lost. It has been found that they often become entangled in the wash load and have to be separated therefrom at the end of the wash.

A further disadvantage is that friction between the beads in the disc is an integral part of the design. This results in wear and a gradual reduction in the size of the beads. Eventually they become small enough to slip through the openings in the discs and are lost with the wash water.

It is accordingly an object of the present invention to alleviate the above difficulties.

SUMMARY OF THE INVENTION

According to the invention there is provided a washing method performed in a washing machine having a wash basket for containing wash water and a wash load, the method including the step of attaching a tile of a ceramic material to the inside of the wash basket so that the tile is exposed to the wash water in the wash basket.

Also according to the invention there is provided a tile of a ceramic material having an outer side and an inner side, wherein the inner side is at least particularly unglazed and including attachment means for attaching the outer side of the tile to the inside of a washing machine.

Further objects and advantages of the invention will become apparent from the description of preferred embodiments of the invention below.

BRIEF DESCRIPTION OF THE DRAWINGS

The invention will now be described, by way of examples, with reference to the accompanying drawings, in which.

DETAILED DESCRIPTION OF PREFERRED EMBODIMENTS

Figure 1:
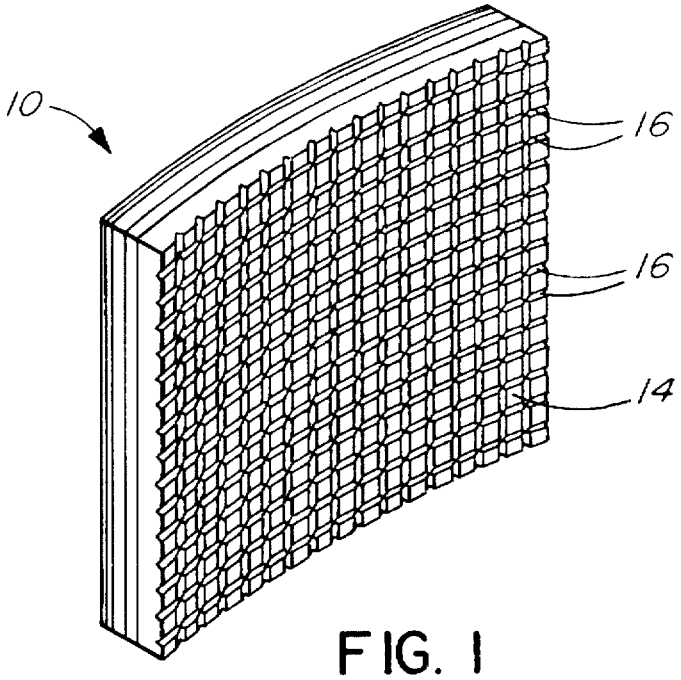
FIG. 1 is a three-dimensional view of a curved ceramic tile designed to fit the wash basket of a particular washing machine.
Figure 4:
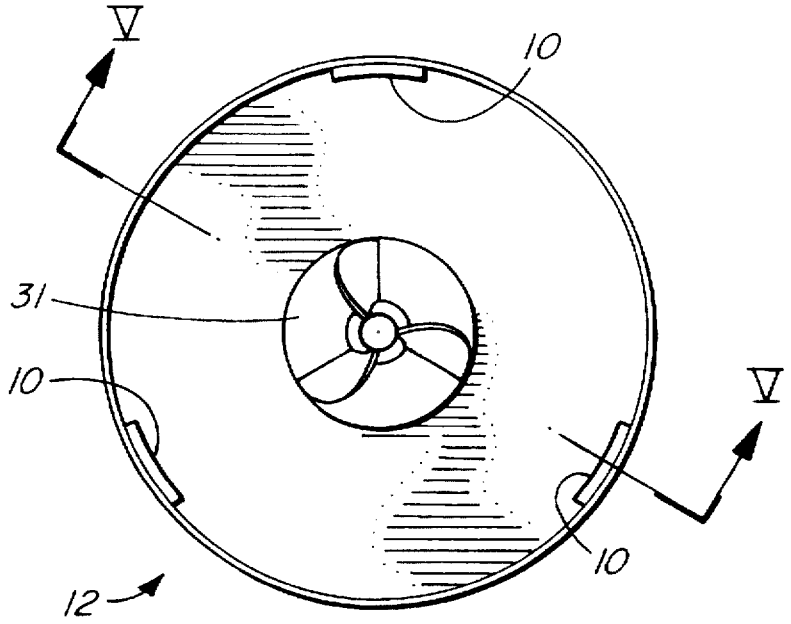
FIG. 4 is a plan view of the wash basket of a washing machine showing three of the tiles of FIG. 1 attached to the inside thereof.
Figure 5:
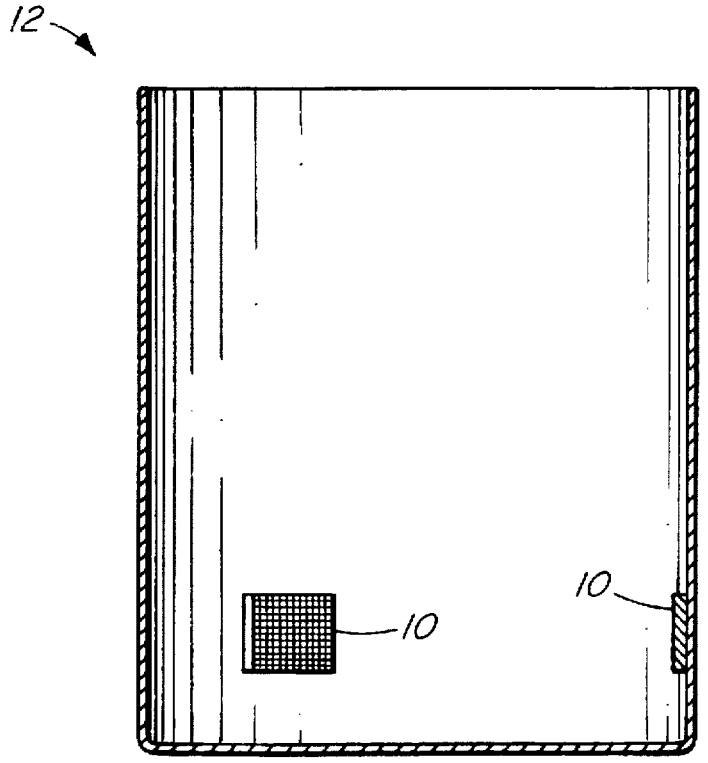
FIG. 5 is a section along the lines V—V in FIG. 4.

In FIG. 1 reference numeral 10 generally indicates a ceramic tile for fitting inside the wash basket or tub 12 of a washing machine, as shown in FIGS. 4 and 5.

The tile 10 is curved to correspond with the curvature of the inside of the wash basket 12. In practice the tile 10 can be produced with different curves in order to fit different types of washing machines.

The tile 10 is of a porous ceramic material and the front or concave side 14 thereof is unglazed.

The concave side 14 is further provided with a pattern in the form of a grid of horizontal and vertical grooves or depressions 16 therein for increasing the surface area thereof.

In the present example, the size of the tile 10 is about 4" along the curved edge and about 3¾" along the straight or vertical edge.

Figure 2:
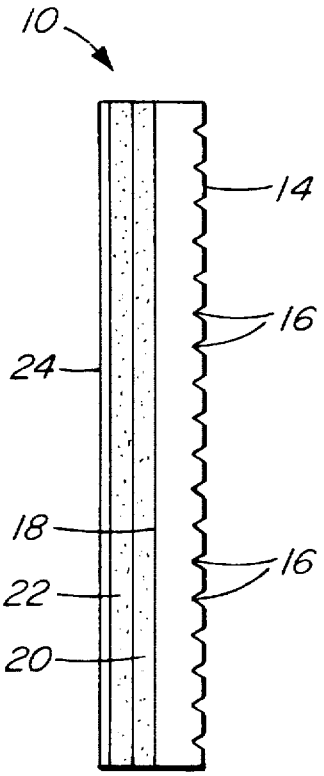
FIG. 2 is an end view of the tile of FIG. 1 showing attachment means for the tile according to one embodiment of the invention.

In one embodiment, as shown in FIG. 2, a pair of matching adhesive strips 20,22, such as Velcro™ strips, are provided on the convex rear side 18 of the tile 10. In order to facilitate the attachment of the strip 20 to the convex side 18, the side 18 is glazed to provide a smooth, firm surface for an adhesive.

The strips 20,22 preferably cover the entire surface of the convex side 18 of the tile 10.

When the adhesive strips 20,22 are of Velcro™, the one half of the pair, preferably the female, is permanently attached to the side 18 of the tile 10, while the male portion is, in use, permanently attached to the inner surface of the wash basket 12 of the washing machine.

It has been found that the mechanical bond between the two mating Velcro™ surfaces is sufficient to hold the tile 10 firmly in position and that the attachment is unaffected by normal vibration of the washing machine during use and immersion in the wash water. This method of attachment provides for the easy replacement of the tile 10 in the unlikely event that it becomes damaged.

When sold to a consumer, the tile 10 can be provided with the pair of adhesive strips 20,22 in position on its concave side 18. In such a case the outside surface of the strip 22 is provided with an adhesive layer for eventual attachment of the strip 22 to the inside surface of the wash basket 12. A protective covering 24 is provided over the adhesive layer, which covering 24 is removed before attaching the strip 22 to the wash basket 12.

Figure 3:
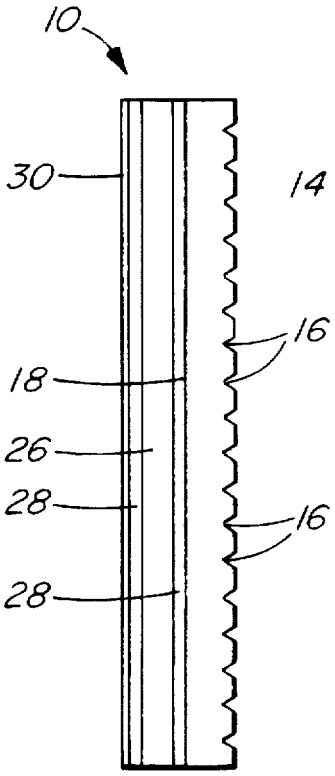
FIG. 3 is an end view of the tile of FIG. 1 showing attachment means for the tile according to another embodiment of the invention.

In an alternative embodiment, as shown in FIG. 3, a layer 26 of rubber or other suitable flexible waterproof material is sandwiched between two layers of double-sided adhesive material 28 which are impervious to water. The inner layer of the adhesive material 28 is attached to the concave side 18 of the tile 10, while the outer layer of adhesive material 28 is provided with a cover strip 30 which is removed prior to attachment of the tile 10 to the wash basket 12.

The flexible layer 26 is of sufficient thickness to compensate for any slight irregularities between the surfaces of the tile 10 and wash basket 12.

In yet another embodiment, adhesive material may be provided separately from the tile 10 as part of a kit with instructions for attaching the tile 10 to the wash basket 12.

As shown in FIGS. 4 and 5, three of the tiles 10 are located on the inside wall of the wash basket 12. However, the number of the tiles may be varied depending on the type and size of the washing machine. The tiles 10 are spaced around the circumference of the wash basket 12 and located near the bottom of the wash basket 12 as shown in FIG. 5.

In FIG. 4, reference numeral 31 denotes the agitator of the washing machine. The agitator 31 has been omitted in FIG. 5 for the sake of clarity.

Figure 6:
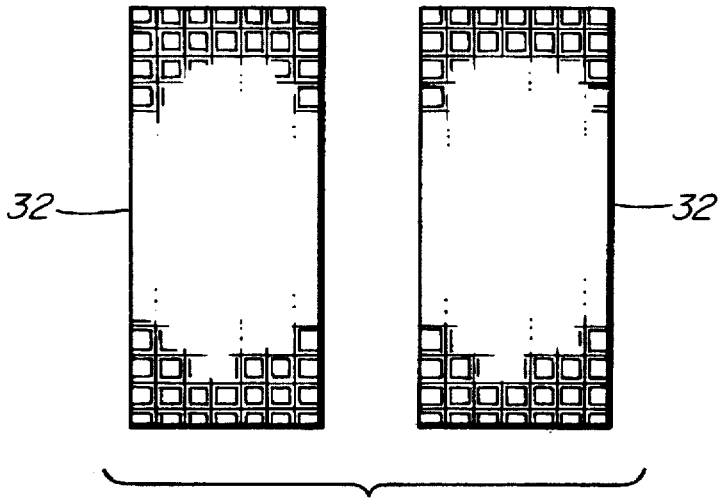
FIG. 6 is a side view of a pair of flat ceramic tiles approximately equal in area to the tile of FIG. 1 for fitting the wash basket of any machine with the same capacity drum as the particular machine for which the tile of FIG. 1 is designed.

Referring now to FIG. 6, an alternative embodiment of the invention is shown in which a pair of elongate tiles 32 are provided in place of the curved tile 10. In combination the tiles 32 have a surface area equal to the surface area of the tile 10.

The tiles 32 are either flat or have only a slight curvature. Since these tiles are narrow, eg. about 1½"×5", they can be attached to washing baskets with different curvatures and are therefore more universal in their application. For example, when provided with the attachment means as shown in FIG. 3, the flexibility and compressibility of the flexible layer 26 will be sufficient to compensate for any slight gap between the tile 32 and the curved surface of the wash basket 12.

Figure 7:
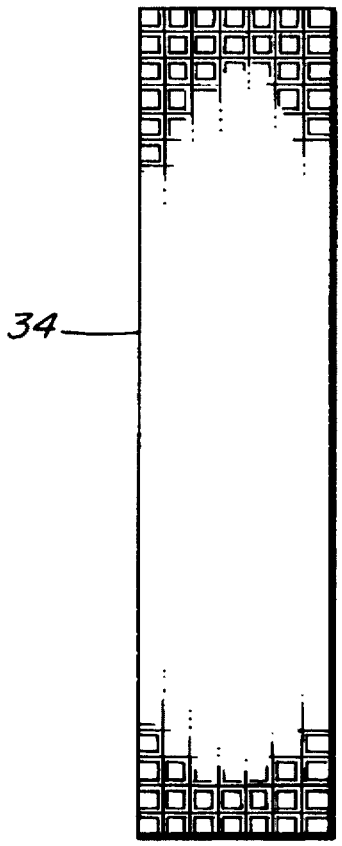
FIG. 7 is a side view of a single tile having the same surface area as the tile of FIG. 1, which can be used instead of the two tiles of FIG. 6 in a machine of the same drum capacity but of a different diameter.

The total surface area of the active ceramic can be maintained by increasing the number of tiles in the wash basket 12 or by increasing the length of each tile 32 to produce a larger tile 34, as shown in FIG. 7. Thus, the tile 34 can be used in place to the pair of tiles 32 in a machine of the same drum capacity.

The laundry tile according to the invention can be used with both domestic and commercial washing machines.

The tile may be sold in kit form with instructions for installation by the user. Each kit may include two or more tiles for installation in a washing machine.

The tiles may be square, rectangular or any other convenient shape. They may be provided in various sizes to suit particular washing machines.

During use of the tiles, the washing machine is filled as usual with an evenly distributed load and the required settings for water level and temperature of the wash water are selected. For a lightly soiled load, no detergent is usually required. For heavier soiling, a small quantity of detergent may be used, or stains may be pre-treated. The time of the wash cycle may also be increased.

Tests have shown that the amount of detergent required can be reduced by a factor of ten or more for each regular to large size wash load. During the wash cycle, agitation of the water and wash load increases the natural cleaning power of the water, as described above. In addition, friction between the wash load and the patterned surface of the tile assists the cleaning action by loosening dirt from the fabric. These cleaning processes are repeated during the rinse cycle.

If desired, a small amount of vinegar may be added to the rinse water to sanitize and freshen the load and to keep the washing machine and associated pipe work free of scale in hard water, as well as to progressively clear any deposits which may have accumulated during any previous use of large amounts of detergent.

The tiles may be of any convenient size required to provide sufficient total surface area of ceramic for obtaining satisfactory results with the maximum amount of water required for a full load in a particular machine.

The tiles are also of sufficient thickness to withstand breakage.

It is an advantage of the invention that the tiles are automatically cleaned by friction with the wash load each time they are used. The tiles are also inexpensive to manufacture and can be provided to the consumer at a relatively low cost. Due to the elimination of detergent or substantial reduction in the amount of detergent used, further costs savings result, as well as the benefits to the environment.

Although the tiles are indicated as being attached to the sides of the wash basket in the described specific embodiments, they may be attached in any other convenient place which comes into contact with water during a wash or rinse cycle, such as the agitator, drum, basket or pipework.

In the manufacture of the tiles the type of ceramic used may be a standard mix normally used for the manufacture of ordinary tiles, pots, plates, vases or similar items.

Although the ceramic tiles have been found to provide satisfactory results, an additional ingredient, tourmaline, may be added to the ceramic mix or applied to the unglazed working surface of the tile before firing in a kiln to enhance the cleaning action. Tourmaline has pyroelectric and piezoelectric properties which enhance the cleaning action of the ceramic.

While the tile according to the invention has been described with reference to use in a washing machine for washing laundry, it is envisaged that the tile may also be used in other types of washing machines, such as dish washing machines.

The invention also extends to a washing machine provided with a tile according to the invention.

While only preferred embodiments of the invention have been described herein in detail, the invention is not limited thereby and modifications can be made within the scope of the attached claims.

What is claimed is:

1. A washing method performed in a washing machine having a wash basket with a generally cylindrical inside surface for containing wash water and a wash load, the method including the of attaching a discrete tile of a ceramic material to the inside surface of the wash basket to provide a ceramic surface projecting above the wash basket inside surface for contact with the wash water in the basket.

2. The method according to claim 1, wherein a plurality of the tiles are attached to the inside of the wash basket and spaced around the inside of the wash basket.

3. A tile of a ceramic material having a front side and a rear side, wherein the front side is at least particularly unglazed and including attachment means for attaching the rear side of the tile to the inside of a washing machine.

4. The tile according to claim 3, wherein the attachment means comprises a pair of mutually engaging attachment strips attached in superimposed relationship to the rear side of the tile.

5. The tile according to claim 3, wherein the attachment means comprises a layer of flexible material which is sandwiched between two layers of double-sided adhesive material, one of said layers of double-sided adhesive being attached to the rear side of the tile.

* * * * *

UNITED STATES PATENT AND TRADEMARK OFFICE

CERTIFICATE OF CORRECTION

PATENT NO. : 5,794,290

DATED : August 18, 1998

INVENTOR(S) : ROBERTS, Denzil S.

It is certified that error appears in the above-identified patent and that said Letters Patent is hereby corrected as shown below:

Column 5, line 2: after "the" add --step--

Signed and Sealed this

Sixth Day of April, 1999

*Attest:*

Q. TODD DICKINSON

*Attesting Officer*

*Acting Commissioner of Patents and Trademarks*